US005926915A

United States Patent [19]

Chou

[11] Patent Number: 5,926,915

[45] Date of Patent: Jul. 27, 1999

[54] RETRACTABLE DRAWBAR DEVICE

[76] Inventor: Cheng-Tsan Chou, 58, Ma Yuan West St., Taichung, Taiwan

[21] Appl. No.: 09/024,014

[22] Filed: Feb. 16, 1998

[51] Int. Cl.[6] ..... A47B 95/02

[52] U.S. Cl. ..... 16/115; 190/115

[58] Field of Search ..... 16/115; 190/151, 190/115, 18 A, 39; 280/655, 655.1, 47.315, 47.371

[56] References Cited

U.S. PATENT DOCUMENTS 5,459,908 10/1995 Chen ..... 16/115
5,469,602 11/1995 Lin ..... 16/115
5,497,865 3/1996 Yun-Pi ..... 16/115
5,553,350 9/1996 Chang ..... 16/115
5,586,628 12/1996 Wang ..... 16/115
5,653,000 8/1997 Lee ..... 16/115

*Primary Examiner*—Chuck Y. Mah

[57] ABSTRACT

A retractable drawbar device is disposed in a suitcase. The retractable drawbar device has a hollow positioning seat, a grip disposed in the hollow positioning seat, a pair of outer pipes connected to the hollow positioning seat, a pair of first tubes inserted in the outer pipes, a pair of second tubes inserted in the outer pipes and connected to the first tubes, and a pair of base seats disposed on the outer pipes.

1 Claim, 8 Drawing Sheets

RETRACTABLE DRAWBAR DEVICE

BACKGROUND OF THE INVENTION

The present invention relates to a retractable drawbar device. More particularly, the present invention relates to a retractable drawbar device for a suitcase.

A conventional retractable drawbar device has a spring-type caliper. However, the spring-type caliper may be useless after a long period of usage.

SUMMARY OF THE INVENTION

An object of the present invention is to provide a retractable drawbar device which can be assembled easily.

Accordingly, a retractable drawbar device comprises a hollow positioning seat, a grip disposed in the hollow positioning seat, a pair of outer pipes connected to the hollow positioning seat, a pair of first tubes inserted in the outer pipes, a pair of second tubes inserted in the outer pipes and connected to the first tubes, and a pair of base seats disposed on the outer pipes. Two rivets fasten the grip and the first tubes. Each base seat has an inner protruded bar. Each outer pipe has an oblong hole receiving the respective inner protruded bar. Each first tube has a first inner flange, and a first elastic clip device. The first elastic clip device has at least a first slot and at least a first protrusion. Each second tube has a second inner flange, and a second elastic clip device. The second elastic clip device has at least a second slot and at least a second protrusion. Each outer pipe has a lower flange blocking the respective second elastic clip device. Each first elastic clip device is inserted in the respective second tube.

DETAILED DESCRIPTION OF THE INVENTION

Figure 1:
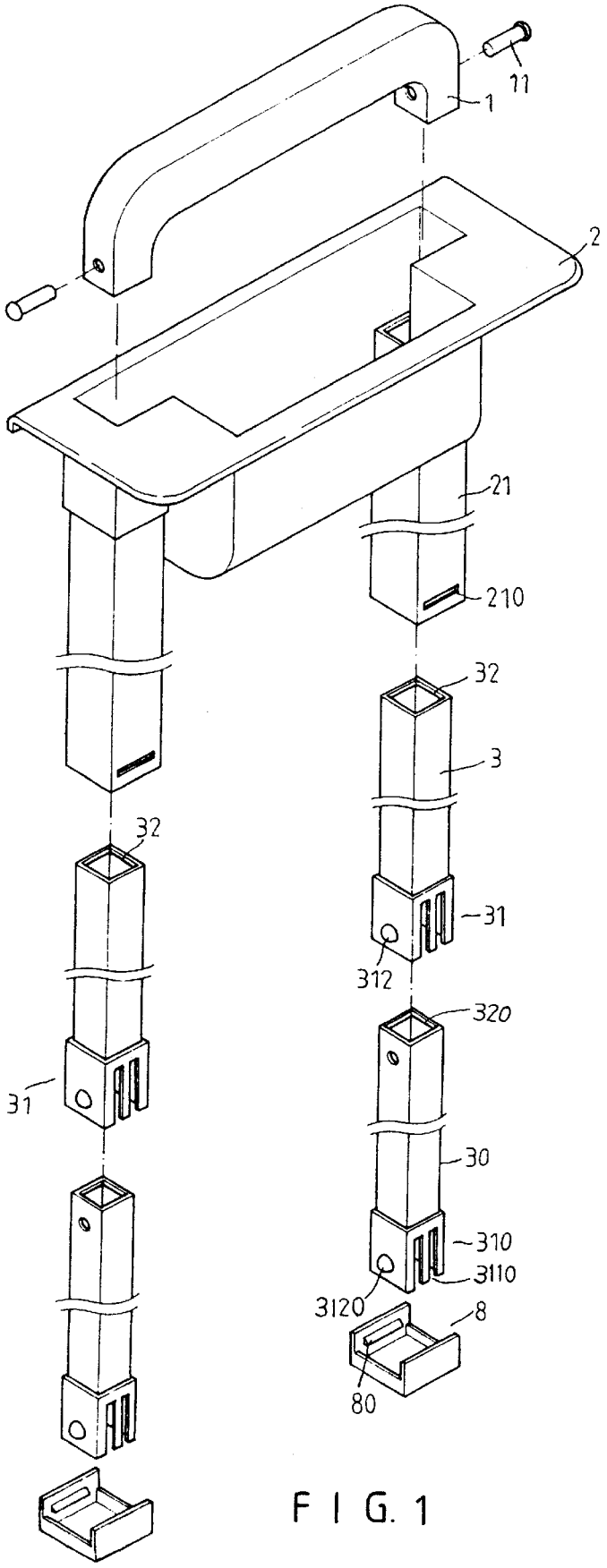
FIG. 1 is a perspective exploded view of a retractable drawbar device of a first preferred embodiment in accordance with the present invention.
Figure 2:
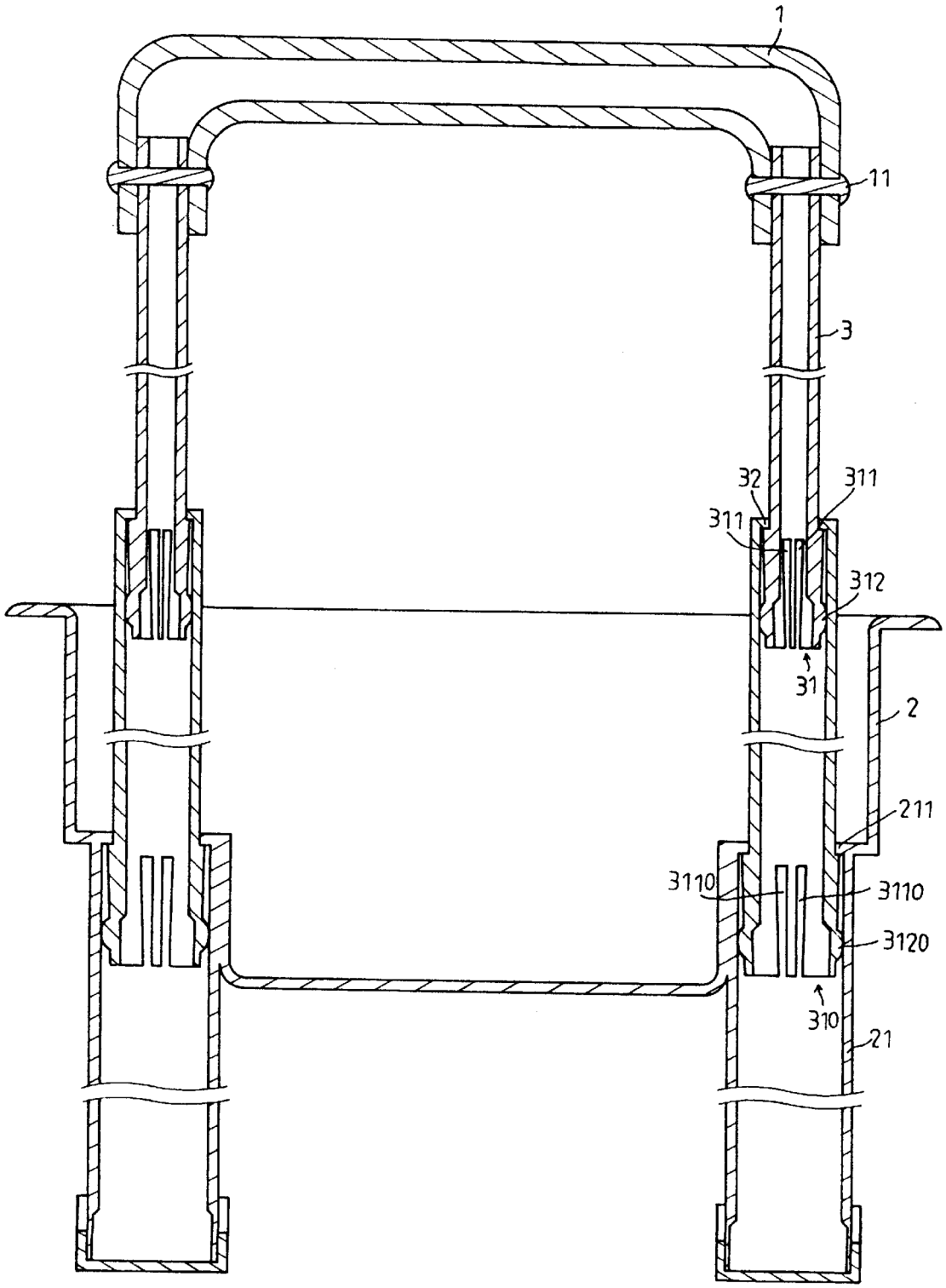
FIG. 2 is a sectional assembly view of a retractable drawbar device of a first preferred embodiment in accordance with the present invention.
Figure 3:
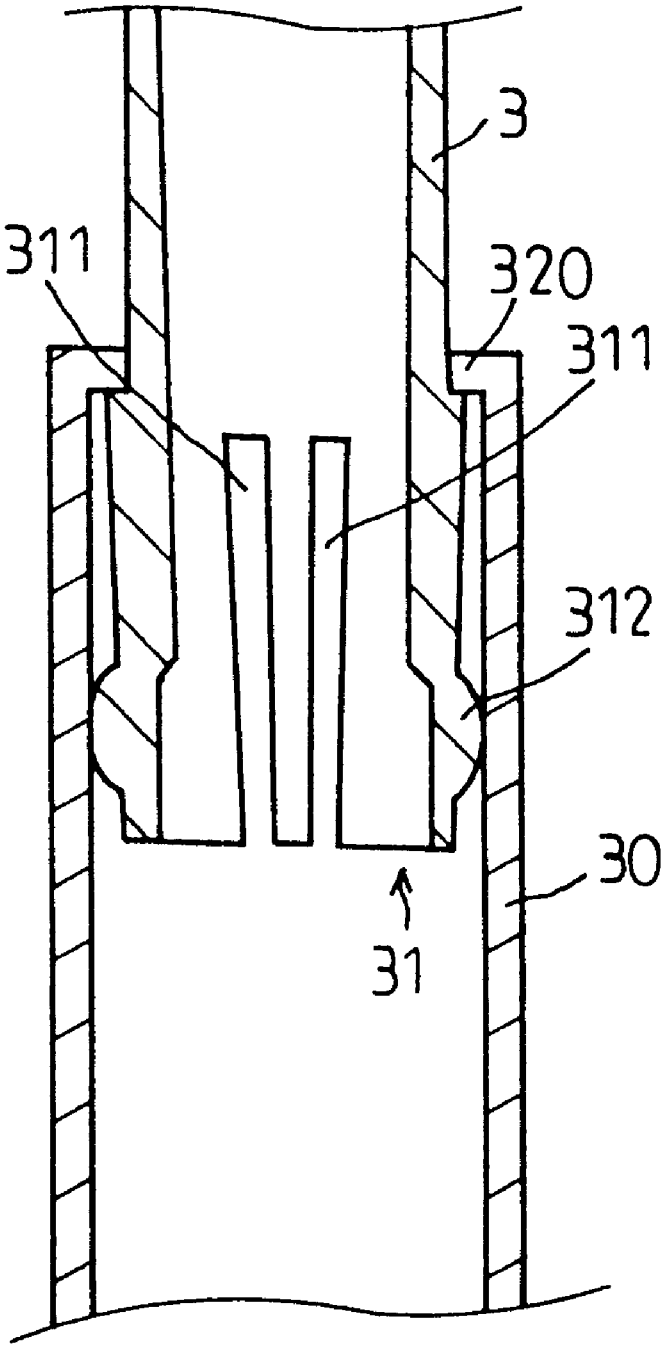
FIG. 3 is a partially sectional assembly view of a first elastic clip device and a second elastic clip device.
Figure 4:
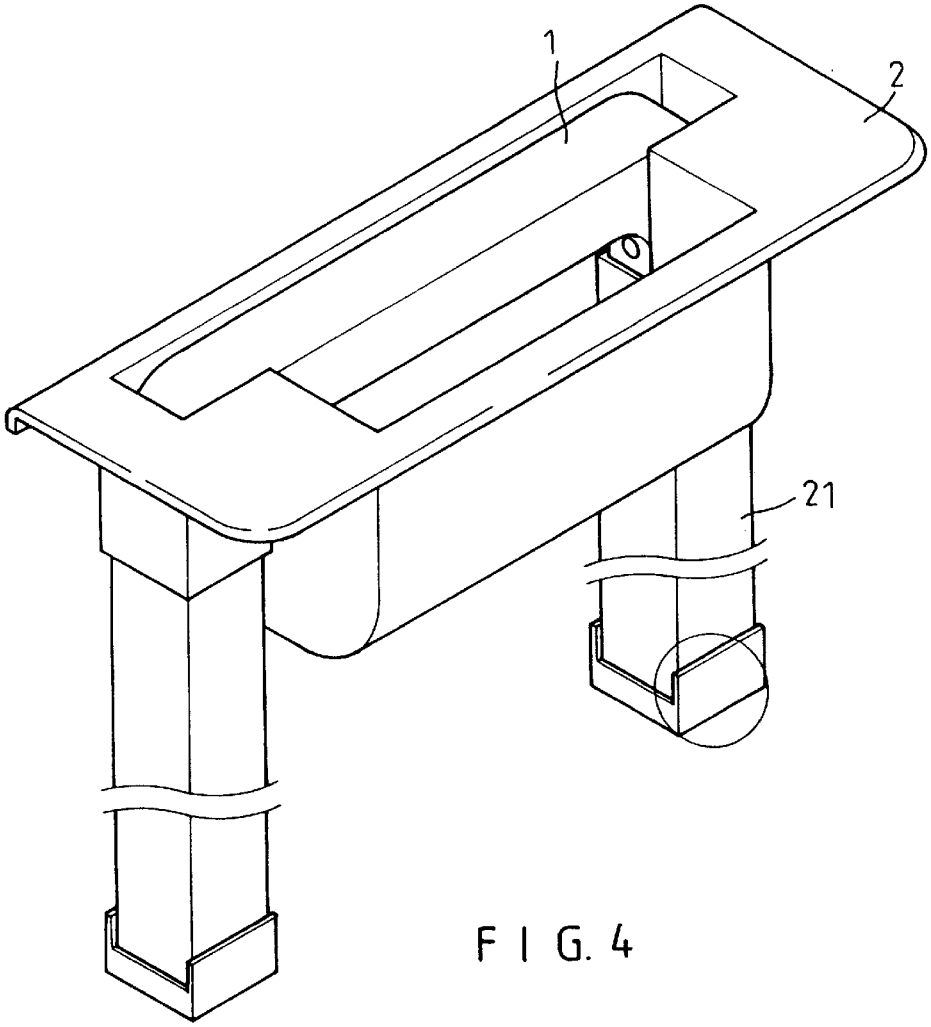
FIG. 4 is a perspective assembly view of a grip and a hollow positioning seat.
Figure 4A:
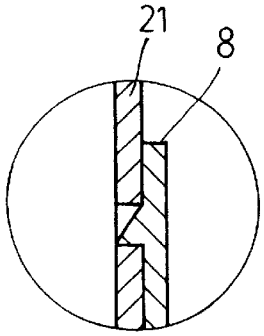
FIG. 4A is a partially sectional assembly view of a base seat and an outer pipe.
Figure 4B:
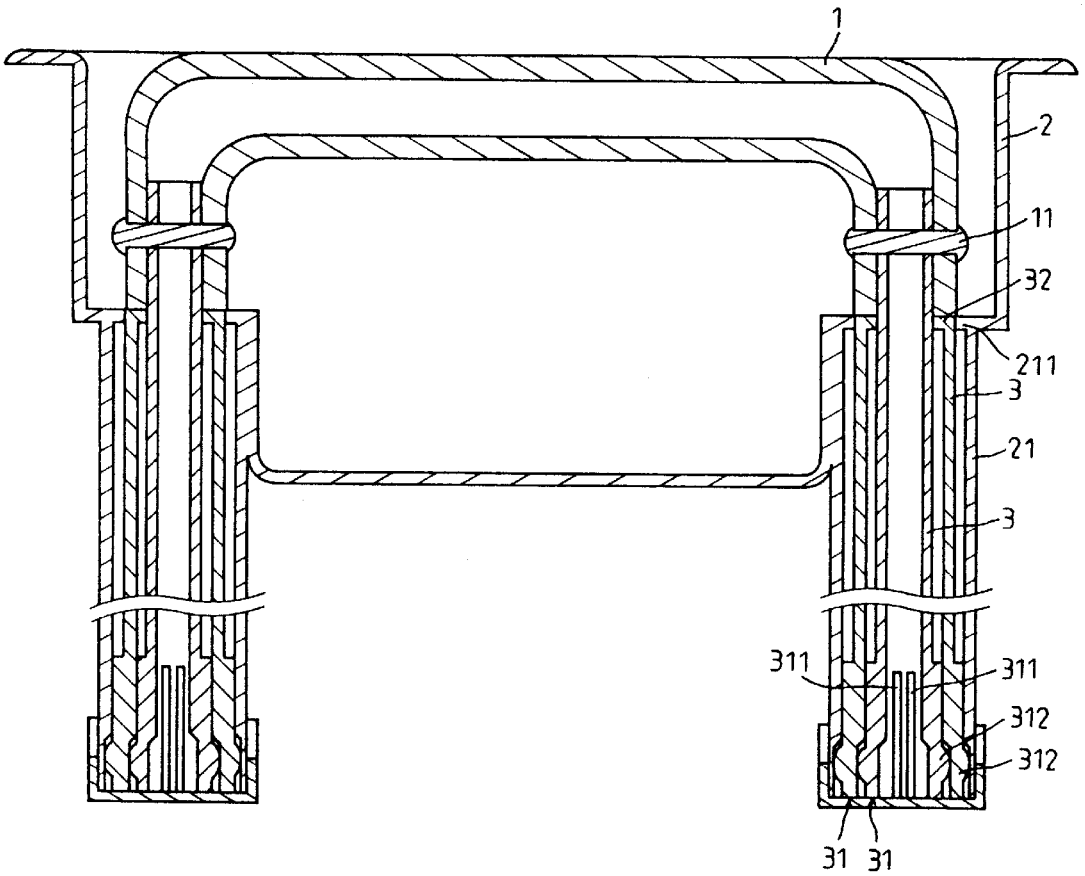
FIG. 4B is a sectional assembly view of a retractable drawbar device of a first preferred embodiment while a hollow positioning seat receives a grip.
Figure 5:
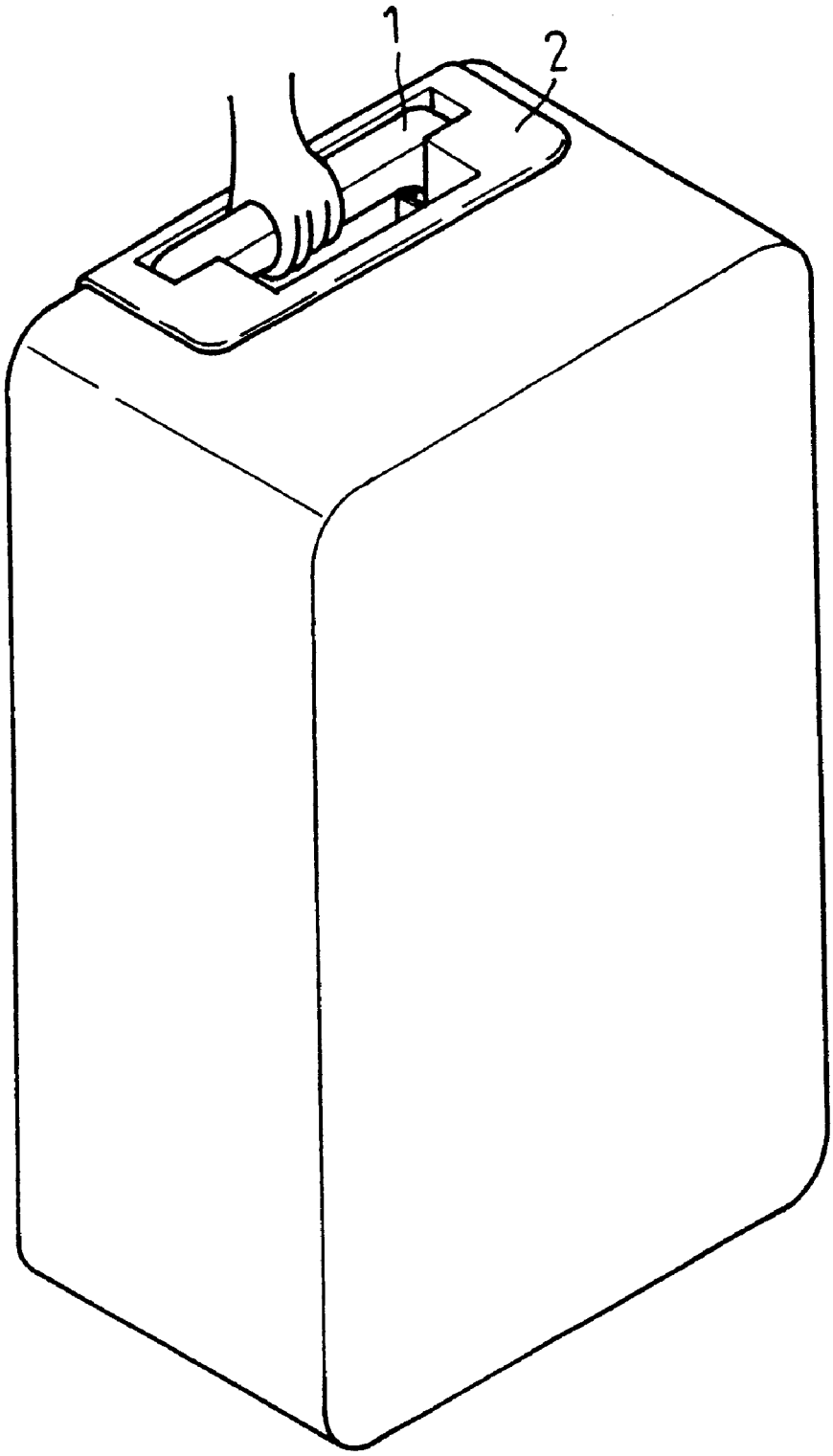
FIG. 5 is a perspective view of a suitcase of a first preferred embodiment while a hollow positioning seat receives a grip.

Referring to FIGS. 1 to 5, a first retractable drawbar device is disposed in a suitcase (as shown in FIG. 5). The first retractable drawbar device comprises a hollow positioning seat 2, a grip 1 disposed in the hollow positioning seat 2, a pair of outer pipes 21 connected to the hollow positioning seat 2, a pair of first tubes 3 inserted in the outer pipes 21, a pair of second tubes 30 inserted in the outer pipes 21 and connected to the first tubes 3, and a pair of base seats 8 disposed on the outer pipes 21. Two rivets 11 fasten the grip 1 and the first tubes 3. Each base seat 8 has an inner protruded bar 80. Each outer pipe 21 has an oblong hole 210 receiving the respective inner protruded bar 80. Each first tube 3 has a first inner flange 32, and a first elastic clip device 31. The first elastic clip device 31 has two first slots 311 and two first protrusions 312. Each second tube 30 has a second inner flange 320, and a second elastic clip device 310. The second elastic clip device 310 has two second slots 3110 and two second protrusions 3120. Each outer pipe 21 has a lower flange 211 blocking the respective second elastic clip device 310. Each first elastic clip device 31 is inserted in the respective second tube 30.

Figure 5A:
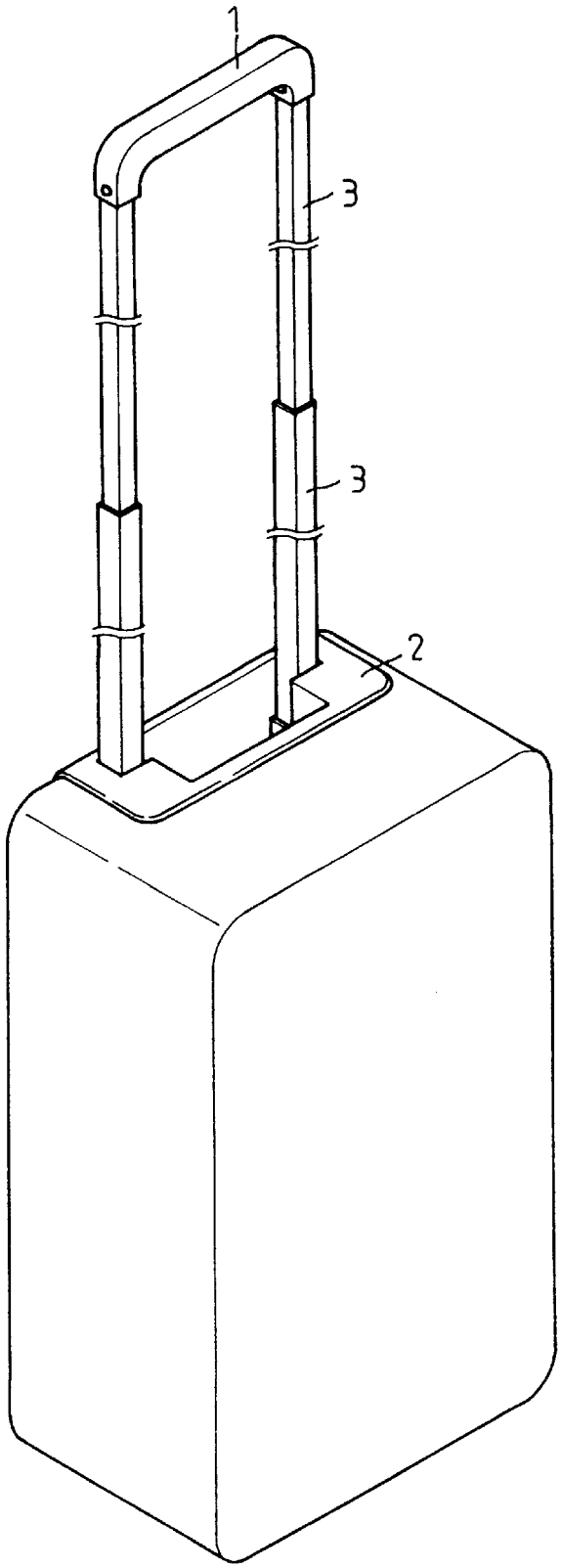
FIG. 5A is a perspective view of a suitcase of a first preferred embodiment while a grip extends upward.

Referring to FIG. 5A, the grip 1 is lifted upward.

Figure 6:
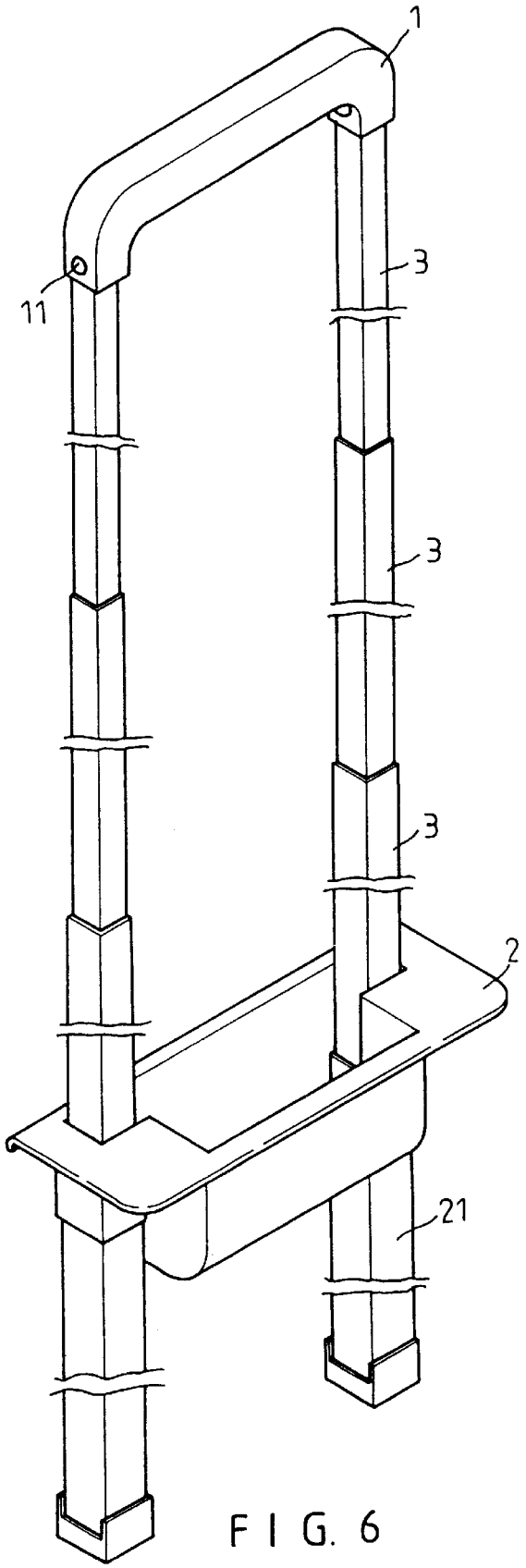
FIG. 6 is a perspective view of a retractable drawbar device of a second preferred embodiment while a grip extends upward.

Referring to FIG. 6, three pair of tubes 3 are provided by the second preferred embodiment in order to replace two pairs of tubes in the first preferred embodiment.

The invention is not limited to the above embodiment but various modification thereof may be made. Further, various changes in form and detail may be made without departing from the scope of the invention.

I claim:

1. A retractable drawbar device comprises:

a hollow positioning seat, a grip disposed in the hollow positioning seat, a pair of outer pipes connected to the hollow positioning seat, a pair of first tubes inserted in the outer pipes, a pair of second tubes inserted in the outer pipes and connected to the first tubes, a pair of base seats disposed on the outer pipes, and two rivets fastening the grip and the first tubes, each said base seat having an inner protruded bar, each said outer pipe having an oblong hole receiving the respective inner protruded bar, each said first tube having a first inner flange, and a first elastic clip device, the first elastic clip device having at least a first slot and at least a first protrusion, each said second tube having a second inner flange, and a second elastic clip device, the second elastic clip device having at least a second slot and at least a second protrusion.

* * * * *